US012329328B1

(12) United States Patent
Holliday

(10) Patent No.: US 12,329,328 B1
(45) Date of Patent: Jun. 17, 2025

(54) RETROFITTABLE WATERLESS URINAL ASSEMBLY WITH ODOR CONTROL AND METHOD OF INSTALLING AND RETROFITTING USING THE SAME

(71) Applicant: Gregory Holliday, Arlington, VA (US)

(72) Inventor: Gregory Holliday, Arlington, VA (US)

( * ) Notice: Subject to any disclaimer, the term of this patent is extended or adjusted under 35 U.S.C. 154(b) by 0 days.

(21) Appl. No.: 19/049,597

(22) Filed: Feb. 10, 2025

(51) Int. Cl.
*A47K 11/12* (2006.01)
*E03D 13/00* (2006.01)

(52) U.S. Cl.
CPC ..... *A47K 11/12* (2013.01); *E03D 13/007* (2013.01)

(58) Field of Classification Search
CPC ..... A47K 11/12; E03D 13/007
See application file for complete search history.

(56) References Cited

U.S. PATENT DOCUMENTS

| | | | | |
|---|---|---|---|---|
| 4,750,219 | A | 6/1988 | Williams | |
| 4,985,940 | A | 1/1991 | Jones | |
| 5,499,405 | A | 3/1996 | Collins | |
| 5,711,037 | A | 1/1998 | Reichardt et al. | |
| 5,799,340 | A | 9/1998 | Hubrig et al. | |
| 6,389,609 | B1 | 5/2002 | Andritz | |
| 6,644,339 | B2 | 11/2003 | Gorges et al. | |
| 8,156,577 | B1 | 4/2012 | Teague | |
| 8,495,769 | B1 * | 7/2013 | Lueck | E03D 13/007 4/301 |
| 8,561,219 | B2 | 10/2013 | Metcalf et al. | |
| 8,739,320 | B1 | 6/2014 | McTaggart | |
| 9,492,308 | B2 | 11/2016 | Plath | |
| 10,077,546 | B2 | 9/2018 | McAlpine | |
| 11,454,014 | B2 | 9/2022 | Moralez | |
| 11,761,189 | B2 | 9/2023 | Smith et al. | |
| 2014/0283292 | A1 | 9/2014 | McKnight | |
| 2024/0101457 | A1 | 3/2024 | Runte et al. | |
| 2024/0200318 | A1 * | 6/2024 | Errickson | E03D 13/007 |

* cited by examiner

*Primary Examiner* — Janie M Loeppke
(74) *Attorney, Agent, or Firm* — Mei & Mark LLP; Manni Li

(57) ABSTRACT

A waterless urinal comprises a receptacle, a lid assembly, and a pipe. The receptacle comprises an inner body and truncated-conical outer body; a leakproof liquid storage chamber is defined between inner and outer bodies. The lid assembly is movably attached to receptacle and comprises a pump spray assembly in fluid communication with the liquid storage chamber and distributes a cleaning solution drawn from the liquid storage chamber to the receptacle in a fine mist. The pipe supports the receptacle and lid assembly and in fluid communication with the receptacle and waste line of a bathroom fixture at a position upstream of a water trap. The waterless urinal may be adapted for female users. A method for installing the waterless urinal to a bathroom fixture is also provided, and a tailpiece may be used to replace a drain line for retrofitting the fixture with the waterless urinal.

15 Claims, 15 Drawing Sheets

RETROFITTABLE WATERLESS URINAL ASSEMBLY WITH ODOR CONTROL AND METHOD OF INSTALLING AND RETROFITTING USING THE SAME

TECHNICAL FIELD

The present invention relates to sanitary plumbing fixtures, particularly, a retrofittable waterless urinal with cleaning and odor control features, a waterless urinal assembly, and method of installing and retrofitting the same to bathroom fixtures.

BACKGROUND OF INVENTION

According to the U.S. Environmental Protection Agency (EPA), toilet flushes constitute the largest single water usage in the home, comprising nearly 30% of indoor use (https://www.epa.gov/watersense/residential-toilets). The federal standard for all new toilet sold in the U.S. is 1.6 gallons per flush (g/f), i.e., all new toilets must meet this requirement. However, older models still in use today can waste as much as 6 gallons per flush. In an effort to reduce the impact on water supply, the EPA created the WaterSense label to encourage companies to innovate for water efficiency. The WaterSense guideline for toilets lowers the standard to 1.28 gallons per flush, which is estimated to result in water savings of 20-60% for consumers (https://www.epa.gov/system/files/documents/2024-05/ws-products-factsheet-tank-type-toilets.pdf). As the average person urinates seven times per day (https://health.clevelandclinic.org/how-often-should-you-pee), that translates to 11.2 gallons of water per person per day, using the federal standard of 1.6 g/f. This usage of water is still wasteful and unnecessary.

The conventional urinals use water to flush each time after urination, because urinals can build up uric acid, calcium, lime, and other minerals from use and splashing, which form a solid scale that clogs urinals, cause bad smells, and create an environment for bacteria growth. U.S. Pat. No. 5,799,340 discloses a water-conserving urinal, which is either attached to the toilet and uses water supply from the tank of the toilet or mounted on the wall and uses water supply from a manually filled water reservoir for flushing. The urinal still uses water for flushing and is difficult to install and cumbersome to use. As the urinal is attached to the bowl or tank of the toilet or mounted on the wall, it is not a pleasant experience to use the toilet or sink in the proximity, and there is a risk of the urinal coming detached from its berth and spilling urine into the room or the user.

U.S. Pat. No. 5,499,405 discloses a urinal that is mounted on the wall and uses water supply from a nearby water supply line of a sink or the like to flush. Similarly, the urinal still uses water for flushing and is costly and difficult to make and install. Further, the urinal is difficult to use and runs the risk of spilling urine into the room or the user.

U.S. Pat. No. 4,750,219 discloses a urinal device that is mounted on the wall and uses water bottle or water supply from a nearby sink for flushing. Part of the flexible conduit that connects the urinal bowl to the drainage pipe forms its own water trap. The urinal relies on water for cleaning, thus, it still uses water. Further, as it directly connects to the plumbing downstream of the P trap, it requires its own water trap, which would always be filled with urine. The cleaning solution is not optimized for standing pools of urine. There is a risk of the device coming detached from its berth and spilling urine into the room or the user. The device is not aesthetically appealing, difficult to install, high cost, and lack environmental sustainability by wasting water.

To solve the problems of buildup and odor control in the absence of water for flushing in the urinal, waterless urinals have been known. See U.S. Pat. Nos. 5,711,037; 6,644,339; 8,739,320. These waterless urinals rely on odor trap cartridges with sealant oils to reduce odor associated with urine. Periodically, the odor trap cartridges need to be replaced, resulting in more waste and work. These waterless urinals are large in size and require specialized plumbing skills to install, thus the cost is high and they are impractical for use in residences. As of today, waterless urinals are not commonly used in residences for reasons including availability of the space in bathrooms, cost, aesthetics, sanitary and maintenance challenges.

SUMMARY OF INVENTION

To solve the problems with urinals and conserve water, the present invention provides a waterless urinal and waterless urinal assembly that eliminate the use of water for flushing. The present invention goes much further than the EPA WaterSense guidelines by completely eliminating water from the urination process with odor control and anti-splashing, anti-dripping features. Even more water may be saved with cleaner bathrooms, because the waterless urinal eliminates splash back, dripping, and aerosolized particles from flushing, resulting in a cleaner toilet area. The waterless urinal and urinal assembly are easy to install and use, low cost to produce, and is suitable for use in limited spaces such as in the home, apartments, and hotels.

The waterless urinal of the present invention comprises:

(1) a receptacle adapted for receiving and discharging urine from a user, wherein the receptacle comprises an inner body in a form of a funnel, wherein the inner body comprises an upper portion and a lower portion, the upper portion defines a cavity for receiving urine, the lower portion comprises a conduit for discharging the urine, and the lower portion is connected to a bottom of the upper portion at a first end and being an outlet for discharging the urine at a second end, an outer body in a form of a truncated cone, wherein the outer body are joined with the inner body at the top and substantially covers the inner body, a bottom of the outer body comprises a passage to allow the lower portion of the inner body to tightly fit and pass through such that the tops and side walls of the inner body and the outer body and the bottom of the outer body together define a leakproof space, a liquid storage chamber provided by the leakproof space, wherein the liquid storage chamber comprises an access port on a top portion of the outer body of the receptacle, and a removable stop member configured to seal the access port and maintain watertightness of the liquid storage chamber;

(2) a lid assembly configured for covering the receptacle and movable between an open and a closed positions, where in the lid assembly comprises an actuation mechanism adapted for being actuated by a user, a cover ring fitted between the actuation member and the top of the receptacle and supports the lid assembly to move between the open and the closed positions, and a pump spray assembly in fluid communication with the liquid storage chamber, wherein the pump spray assembly is configured to be activated by the actuation member, and in response, to distribute a cleaning solution from the liquid storage chamber to the receptacle in a form of a mist; and (3) a pipe in fluid communication with the receptacle for discharging the urine to a waste line, wherein the pipe is connected to the receptacle through a first fitting member and to the waste line through a second fitting member, and the pipe bendably and flexibly supports the receptacle and the lid assembly to move to different positions and heights.

In the present invention, the pipe may be connected to the waste line at a position upstream of a water trap in the waste line.

In the present invention, the inner body may comprise a fold over rim along a circumference at the top of the inner body, and the top of the outer body are joined with the fold over rim.

In the present invention, the downward inclination angle $\alpha$ of the side wall of the outer body is smaller than a downward inclination angle $\beta$ of the side wall of the upper portion of the inner body.

In the present invention, the cover ring may be pivotally attached to the receptacle through hinge structure.

The waterless urinal of present invention may be adapted for use by female users, where the waterless urinal further comprises an accessory receptacle adapted for use by a female user, wherein the accessory receptacle comprises a cup portion and a ring portion, the cup portion is configured to receive urine from the female user, and a ring portion is connected to the cup portion and snuggly fitted to the top of the receptacle, wherein the lid assembly is configured to cover the cup portion and the ring portion of the accessory receptacle.

In the present invention, the pump spray assembly further comprises a tube connecting the liquid storage chamber with the pump spray assembly through a tightly fit access port on the removable stop member, a piston configured to be activated by the actuation means, wherein the piston comprises an upper chamber and a lower chamber in fluid communication and separated by a separation layer, the upper chamber provides a snuggly fitted access port for the tube, the separation layer comprises a plurality of distribution holes and is removably sealed by a first body valve, a spring configured to being compressed by the piston and movable between a compressed state and a released state, a pump cylinder plate configured to join with the cover ring at perimeter, wherein the pump cylinder plate comprises a cylinder housing portion and a plurality of distribution holes, the cylinder housing portion and the lower chamber of the piston define a housing to snuggly fit the spring, and a bottom of the pump cylinder plate is removably sealed by a second body valve, an O-ring between the piston and the cylinder column portion of the pump cylinder plate to ensure a snug fit, a nozzle distribution plate attached to the bottom of the pump cylinder plate, wherein the nozzle distribution plate comprises a plurality of distribution holes and is configured to distribute the cleaning solution drawn from the liquid storage chamber to the receptacle.

In the present invention, the pluralities of the distribution holes on the separation layer of the piston, the pump cylinder plate, and the nozzle distribution plate may be mismatched in place, different in sizes and configurations, or both, to create a fine mist to the receptacle.

In the present invention, preferably, the cleaning solution is a cleaning vinegar.

In the present invention, the pipe may be coated with an anticorrosive layer on an inside wall, an outside wall, or both.

The present invention further provides a waterless urinal assembly, comprising the waterless urinal of the present invention and a tailpiece configured to connect a drain line of a bathroom fixture to a waste line and provide an access port for connecting with the pipe through the second fitting member.

The present invention further provides a method for installing a waterless urinal in connection with a bathroom fixture, which comprises the steps of providing the waterless urinal of the present invention, providing an access port on a drain line of a bathroom fixture, connecting the pipe to the access port through the second fitting member, wherein the access port is upstream of a water trap.

In the present invention, the bathroom fixture may be a sink or wash basin with a pop-up drain, and the method may further comprise removing the pop-up drain to expose the access port on the drain line used by the removed pop-up drain and installing and connecting the pipe to the access port.

In the present invention, the water trap may be a P-trap.

In the present invention, when the bathroom fixture does not have a pop-up drain, the method further comprises providing a tailpiece configured to connect the drain line of a bathroom fixture to a waste line and provide the access port for the pipe, substituting the drain line of the bathroom fixture with the tailpiece, and installing and connecting the pipe to the access port.

The waterless urinal of the present invention connects to existing plumbing under bathroom sinks and only occupies unused space beneath, thus, it saves space in the bathroom. The device is low-cost to produce and can be easily installed without special plumbing skill. The device is simple, sleek, small, and attractive on its own, but also easily hidden if desired. The lid assembly with integrated fine mist spray makes it easy for the user to clean with one push of a button that dispenses a cleaning solution that eliminates odor and clogging of pipes.

BRIEF DESCRIPTION OF THE DRAWINGS

FIG. 12A is a perspective side view of the waterless urinal in an open position, FIG. 12B is a partial perspective view of the accessory receptacle used in the embodiment, and FIG. 12C is a side view of the lid assembly adapted for use by the female user.

Figure 1A:
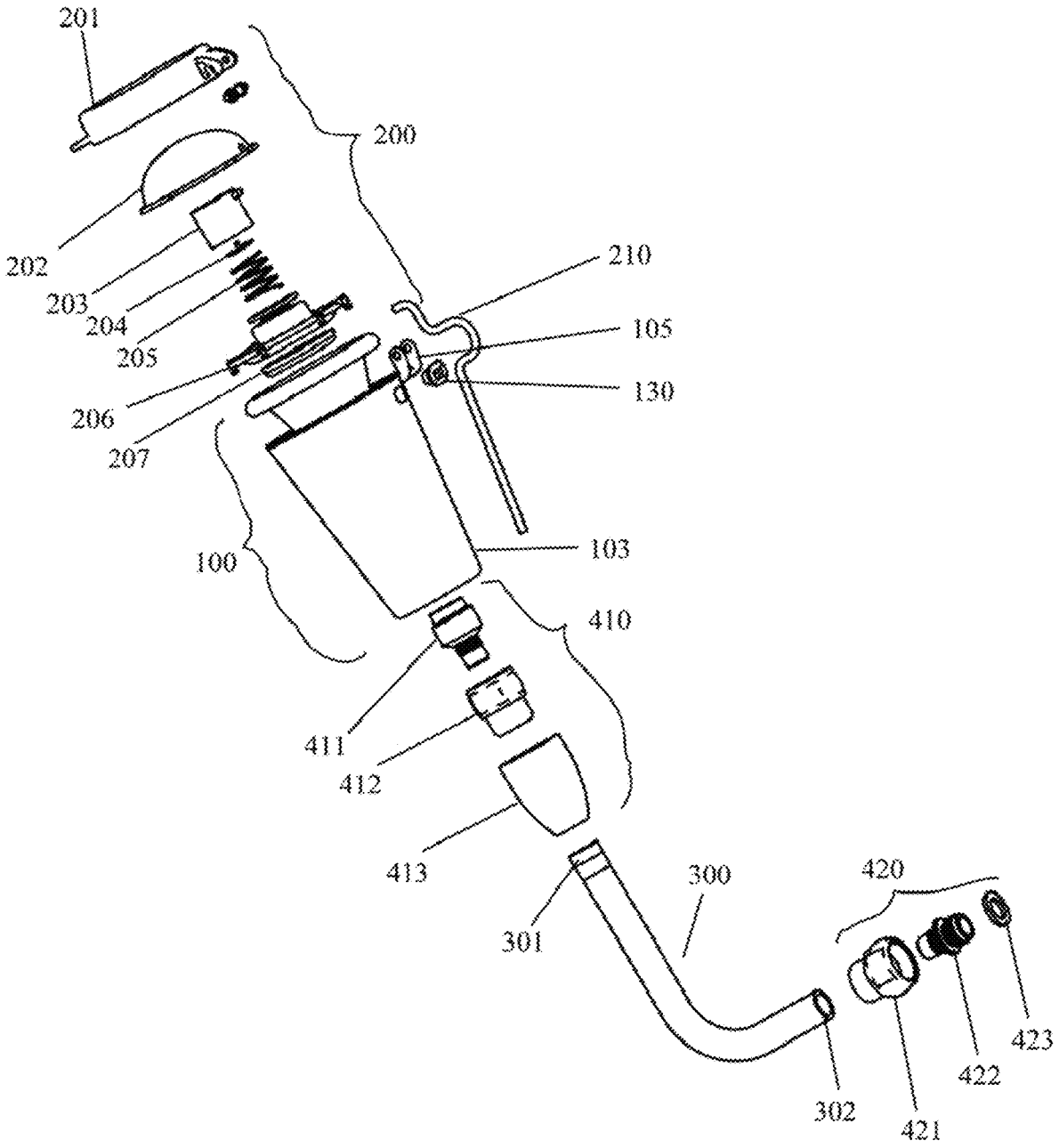
FIG. 1A is an exploded view of the waterless urinal of the present invention.

Reference numbers used in the drawings refer to the following structures:

100—receptacle; 101—inner body; 102—fold over rim; 103—outer body; 104—hinge pin; 105—bottom hinge; 114—upper portion of inner body; 115—cavity; 116—lower portion of inner body; 117—liquid storage chamber; 118—outlet; 119—access port; 120—bottom of outer body; 121—hole; 130—removable stop member; 131—protrusion; 132—tab; 133—passageway; 140—accessory receptacle; 141—cup portion; 142—annular portion; 143—female cover ring; 144—elongated portion; 145—main portion;

200—lid assembly; 201—cover ring; 202—actuation mechanism (button); 203—piston; 204—first body valve; 205—spring; 206—pump cylinder plate; 207—nozzle distribution plate; 208—O ring; 209—second body valve; 210—tube; 212—screws; 221—protrusion; 222—screwed holes; 223—orifice or distribution holes on the nozzle distribution plate; 224—upper chamber; 225—lower chamber; 226—separation layer; 227—cylinder housing; 228—distribution holes (piston separation layer); 229—center on separation layer (for body valve 204); 230—distribution holes on the pump cylinder plate; 231—bottom of pump cylinder plate;

300—pipe; 301—first end; 302—second end;

410—first fitting member; 411—male fitting; 412—female fitting (fitting nut); 413—cover cone; 420—second fitting member; 421—female fitting (fitting nut); 422—male fitting; 423—drain seal;

501—sink/wash basin; 502—lever for pop-up drain; 503—drain line;

600—tailpiece; 601—access port for pipe; 602—nut.

DETAILED DESCRIPTION OF THE INVENTION

The present invention is described in detail in connection with the drawings. Examples and embodiments as described below and drawings should not be interpreted as limiting the scope of the present invention. Any one of ordinary skill in the art may modify or change the specific examples and embodiments as described without departing from the scope of the present invention.

In order to concisely describe the present invention, some structural components that are well known to those skilled in the art but not related to the main content of the present invention may be omitted in the drawings or descriptions. In addition, for the convenience of description, some parts in the drawings may be omitted, enlarged, or reduced, so they may not represent the size or entire structure of the waterless urinal of the present invention.

As shown in FIG. 1A, the waterless urinal of the present invention comprises a receptacle 100, a lid assembly 200, and a pipe 300. The lid assembly 200 is removably attached to the receptacle 100 and movable between an open and a closed positions. In the open position, it allows a user to urinate into the receptacle 100; in the closed position, the lid assembly 200 covers the top of the receptacle. The bottom of the receptacle 100 is connected to and in fluid communication with a first end 301 of the pipe 300 through a first fitting member 410, and the second end 302 of the pipe 300 is attached to a drain line 503 of a sink or wash basin 501 (shown in FIG. 14) through a second fitting member 420. The pipe 300 is self-supporting and supports the receptacle 100 and the lid assembly 200; it is bendable and flexible to move to a comfort position for the user to use or to be concealed under or behind the bathroom fixture.

In one embodiment of the present invention, the waterless urinal consists of the receptacle 100, the lid assembly 200, and the pipe 300.

As shown in FIGS. 1A, 1B, 2A, and 2B, the receptacle 100 comprises an inner body 101 and an outer body 103. The receptacle 100 is adapted for receiving urine from a user and discharging the urine to the waste line. It is made of durable material that is suitable for bath fixtures, including but not limited to, stainless steel, vitreous China, glass, PVC, other plastics, etc. The receptacle 100 has a double-layered side wall structure that defines a leakproof space between the inner and outer bodies.

Figure 3:
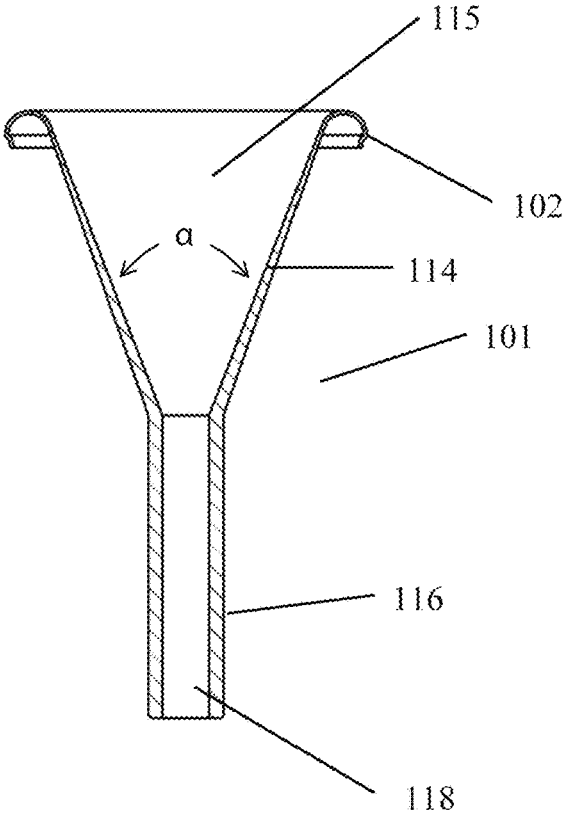
FIG. 3 is a cross-sectional view of the inner body of the receptacle in the present invention.

The configuration of the inner body 101 is designed to eliminate splashing and dripping. As shown in FIG. 3, the inner body 101 is in a funnel-like configuration having an upper portion 114 and a lower portion 116. The top of the inner body 101 may be defined by a fold over rim 102 along the circumference. The circumference of the top of the inner body and the outer body are joined with each other to define the top of the receptacle. The side wall of the upper portion 114 defines a cavity 115 for receiving urine. The upper portion 114, including the side wall and cavity 115, is configured to facilitate downward flow of urine. For examples, the shape of the upper portion 114 may be semi-spherical, oval, elliptical, conical, rectangular, or polygonal. The lower portion 116 is in the form of a conduit and serves as an outlet 118 for discharging the urine.

Figure 2A:
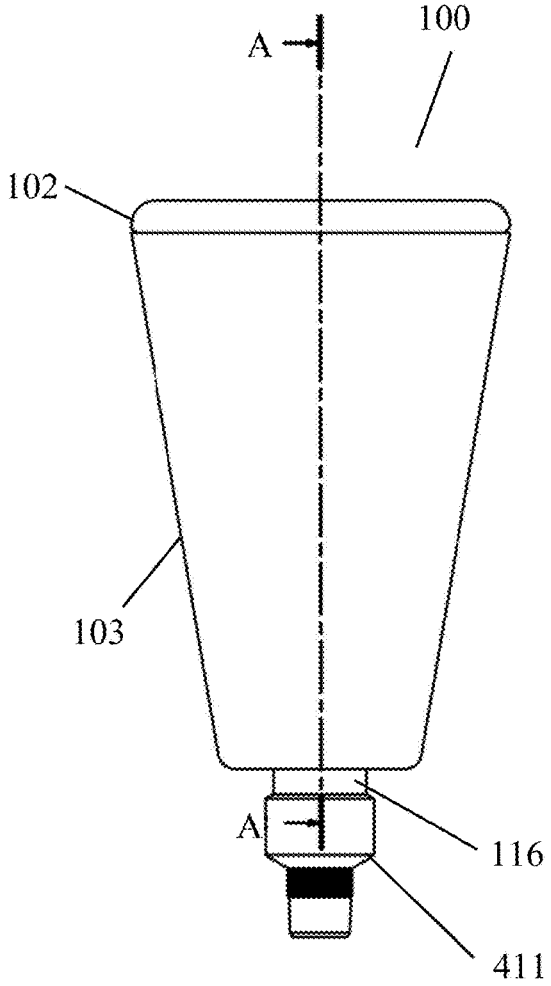
FIG. 2A is a side view of the receptacle in the present invention.
Figure 2B:
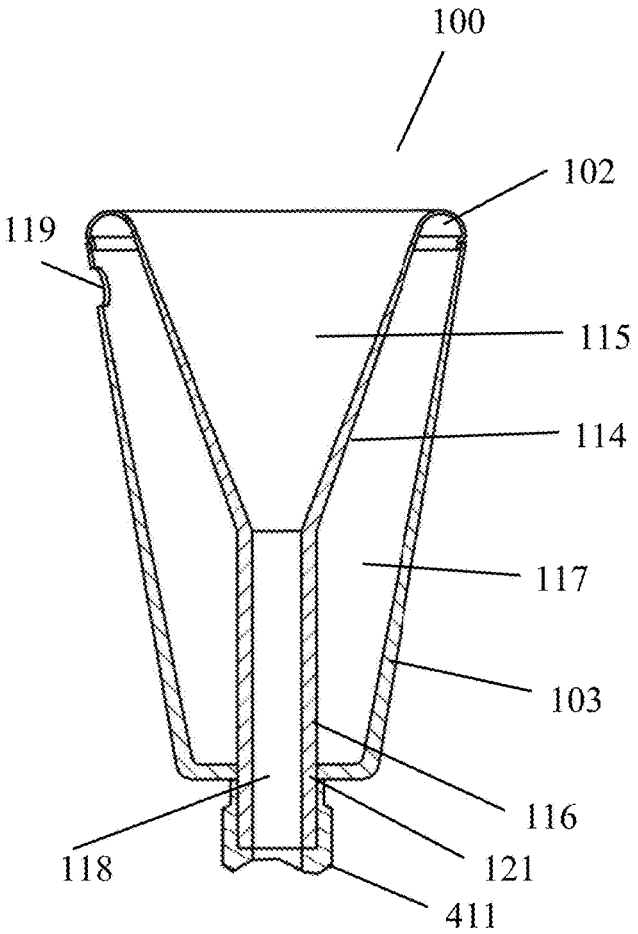
FIG. 2B is a cross-sectional view of the receptacle along A-A line as shown in FIG. 2A.
Figure 4:
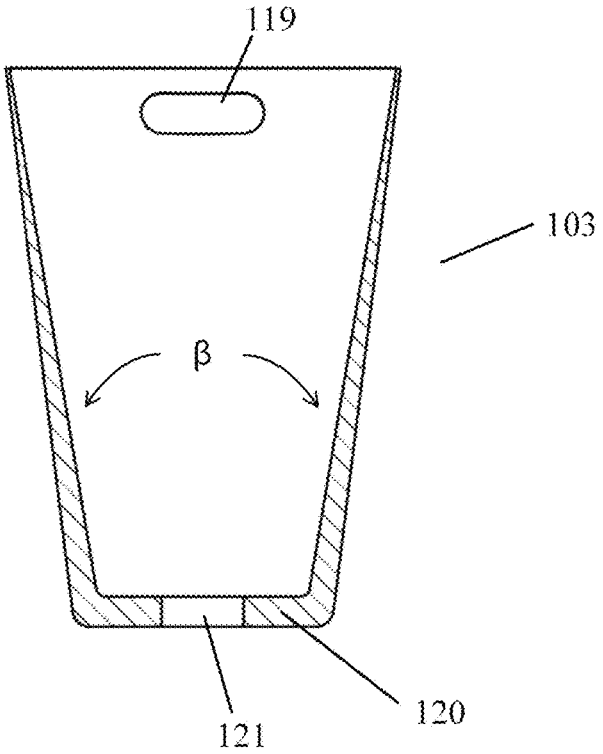
FIG. 4 is a cross-sectional view of the outer body of the receptacle in the present invention.

As shown in FIGS. 2A, 2B, and 4, the lower portion 116 extends through the bottom of the outer body 103 through a tightly fitting hole 121 and may be screwed into the male fitting 411 of the first fitting member, and through the female fitting 412, to be connected to the pipe 300.

In the embodiment as shown in FIG. 3, the upper portion 114 has a tapered side wall towards the top of the receptacle, and the lower portion 116 has a side wall with uniform thickness. The height of the lower portion 116 is approximately the same as the height of the upper portion 114. The downward inclination angle of the side wall a is about 39°. The diameter of the lower portion 116 is in a range of 0.6 to 1.4 inch, preferably 0.65 to 1.2 inch, and more preferably, 0.75 to 1 inch.

As shown in FIG. 4, the outer body 103 is in the form of a truncated cone that can substantially cover the inner body 101. Similarly to the upper portion 114 of the inner body 101, the outer body 103 has a tapered side wall towards the top of the receptacle. The bottom 120 of the outer body 103 is also watertight sealed except that it comprises a hole 121 to tightly fit and allow the lower portion 116 of the inner body 101 to pass through. The sidewall of the outer body 103 has a downward inclination angle $\beta$ that is less steep than the inclination angle $\alpha$ of the sidewall of the inner body 101. In the embodiment, the angle $\beta$ is about 10°.

As shown in FIG. 2B, the top portion of the outer body 103 is coextensive upward with the upper portion 114 of the inner body 101, and the circumference at the top of the outer body 103 matches the circumference of the fold over rim 102 of the inner body 101 so that the fold over rim 102 of the top of the inner body 101 and the top of the outer body 103 are joined together and tightly sealed by welding, glue, or other means known in the art. Therefore, the tops and the side walls of the inner and outer bodies, along with the closed bottom of the outer body 103 form the double-layered wall structure in the receptacle and define a leakproof space in the receptacle.

Figure 1B:
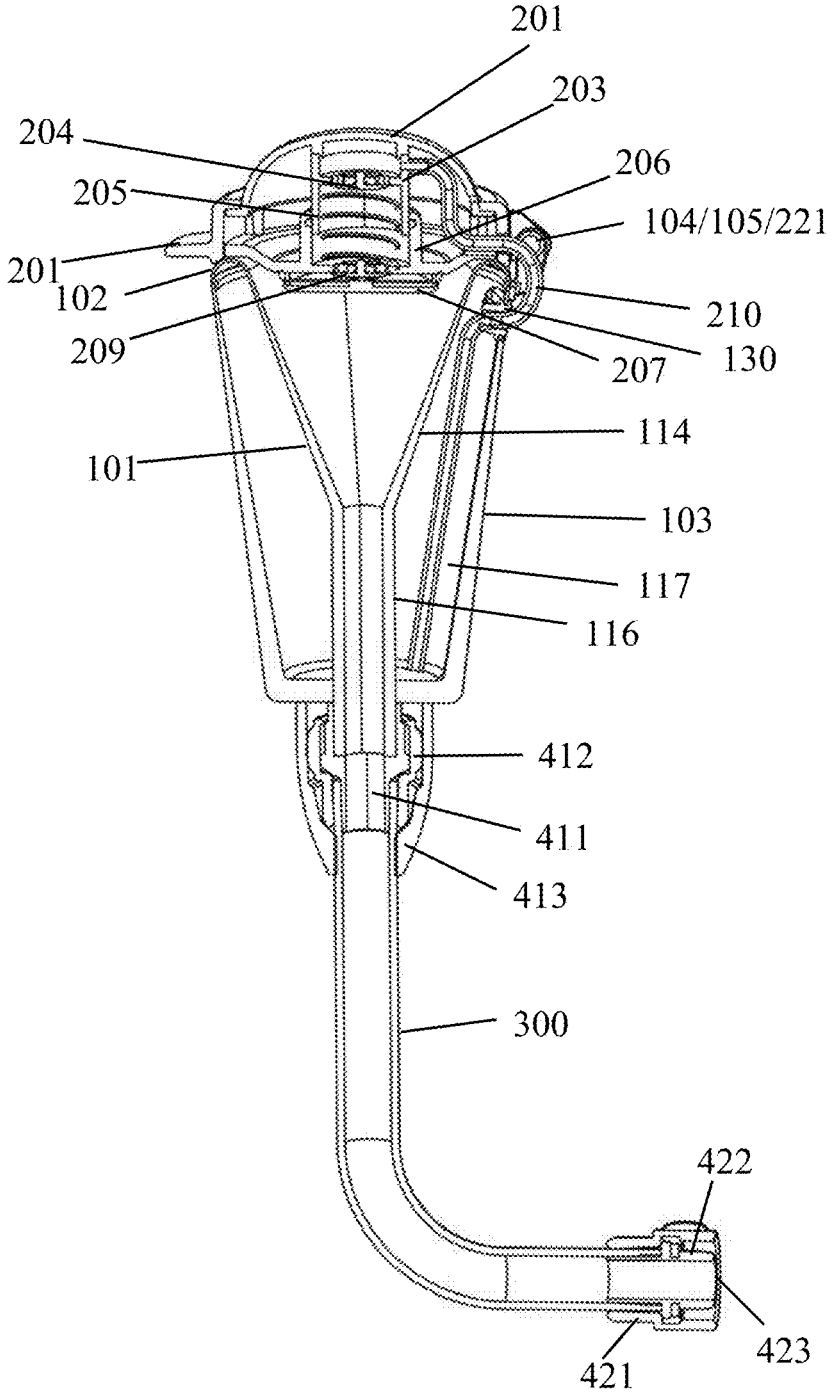
FIG. 1B is a cross-sectional view of the waterless urinal of the present invention.

As shown in FIGS. 1B and 2B, a liquid storage chamber 117 is formed by the leakproof space, and an access port 119 is provided at the top portion of the outer body 103 for refilling and replenishing the cleaning solution inside the liquid storage chamber 117 and for the tube 210 of the pump spray assembly to be inserted. The liquid storage chamber 117 holds a cleaning solution to be distributed by the lid assembly to the receptacle to prevent urinal build-up salts, neutralize urine, and control the foul smell. The liquid storage chamber 117 holds about 12 oz to 30 oz cleaning solution, preferably, 15 oz to 25 oz cleaning solution, and more preferably, approximately 20 oz cleaning solution. The cleaning solution may be a non-chemical or a chemical cleaning solution, and preferably an all-natural, non-chemical liquid. For examples, the cleaning solution may be a diluted white vinegar at a concentration of 6%.

Figure 5A:
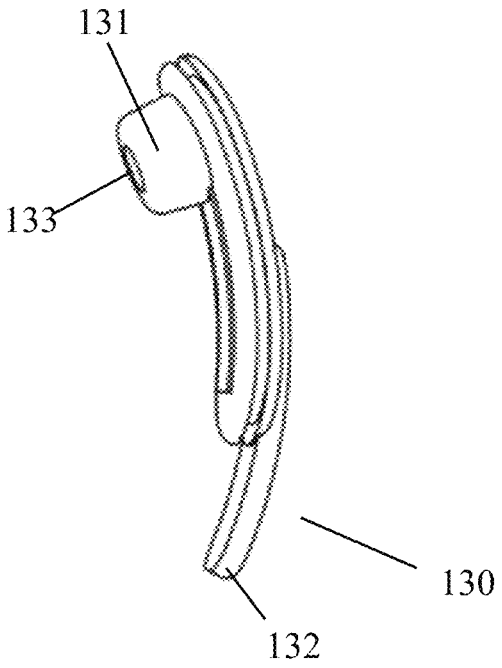
FIG. 5A is a side view of the removable stop member.
Figure 5B:
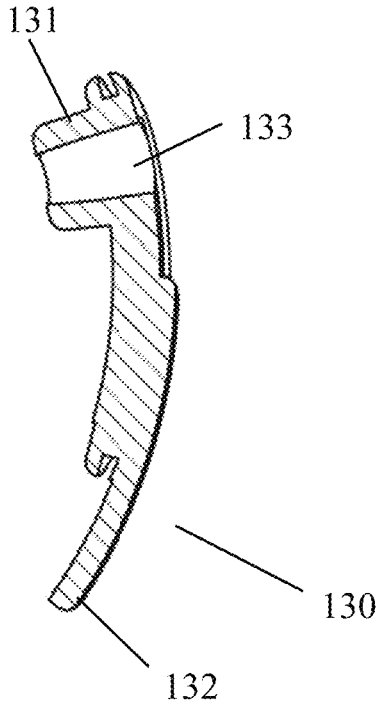
FIG. 5B is a cross-sectional view of the removable stop member.

As shown in FIGS. 4, 5A, and 5B, a removable stop member 130 is provided to snugly plug in the access port 119 near the top of the outer body of the receptacle and seal the liquid storage chamber 117 to ensure the watertightness. The removable stop member 130 further comprises a protrusion 131 with a slightly tapered inner passageway 133 on one end, through which a tube 210 from the pump spray assembly snuggly fits through. The removable stop member 130 may be made of rubber. The other end 132 of the removable stop member 130 is provided with a small tab that can be pulled up to expose the access port 119, and the cleaning solution can be refilled and replenished in the liquid storage chamber 117. When refilling is complete, the removable stop member 130 is pushed snugly back into place covering the access port 119 so that the liquid storage chamber 117 remains watertight and airtight.

As shown in FIGS. 1A, 1B, 6A, and 6B, the lid assembly 200 comprises a cover ring 201, an actuation mechanism 202, and a pump spray assembly embedded in the lid assembly 200 and comprising a piston 203, a first body valve 204, a spring 205, a tube 210, a pump cylinder plate 206, a nozzle plate 207, an O ring 208, and a second valve 209. The lid assembly may be pivotally attached to the receptacle 100 and movable between an open and a closed positions, where the lid assembly may be attached to the top of the receptacle through a hinge structure.

Figure 7A:
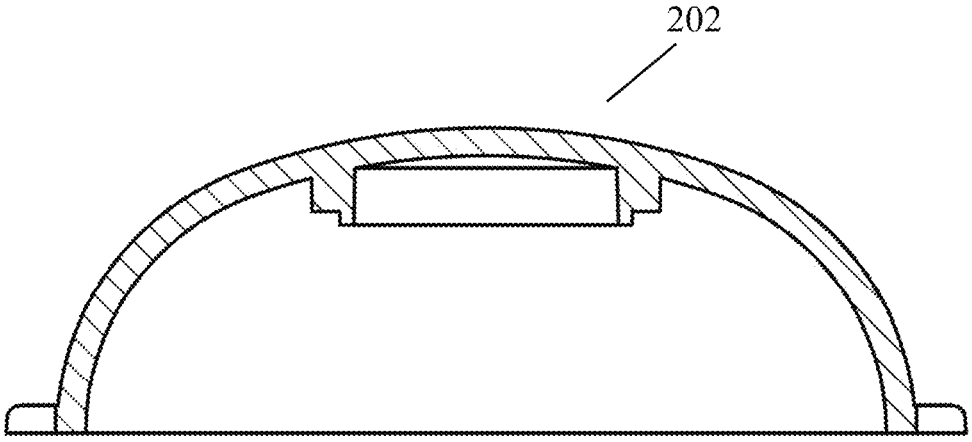
FIG. 7A is a cross-sectional view of one embodiment of the actuation mechanism in the lid assembly of the present invention.
Figure 7B:
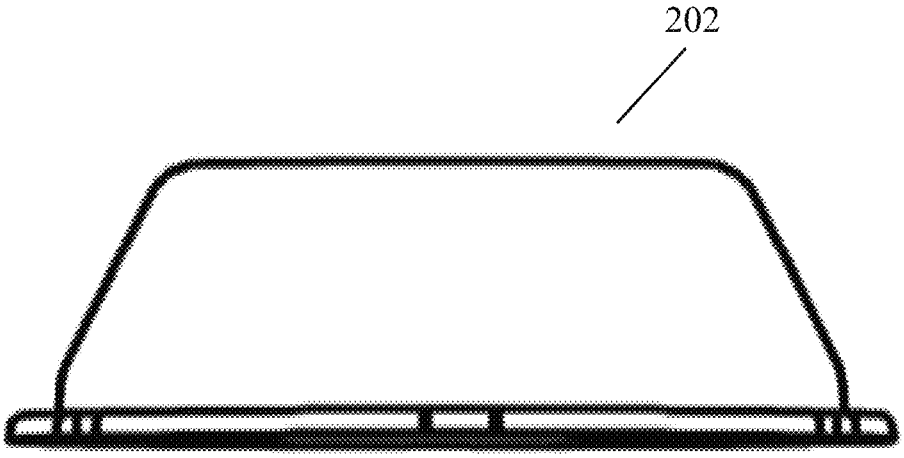
FIG. 7B shows another embodiment of the actuation mechanism in the lid assembly of the present invention.

In the lid assembly, the actuation mechanism 202 is adapted for being activated by a user and act on the pump spray assembly to distribute the cleaning solution. The actuation mechanism 202 may be of any conventional means or configurations used by a user to exert a force on the piston of the pump spray assembly and activate the pumping action. The actuation mechanism may be a button, a lever, a switch, either mechanical or electrical, or may be triggered by detection of a certain motion. In a first embodiment as shown in FIG. 7A, the actuation mechanism 202 is a dome-shaped button, in a second embodiment as shown in FIG. 7B, the actuation mechanism 202 is a button with a flat top.

Figure 8A:
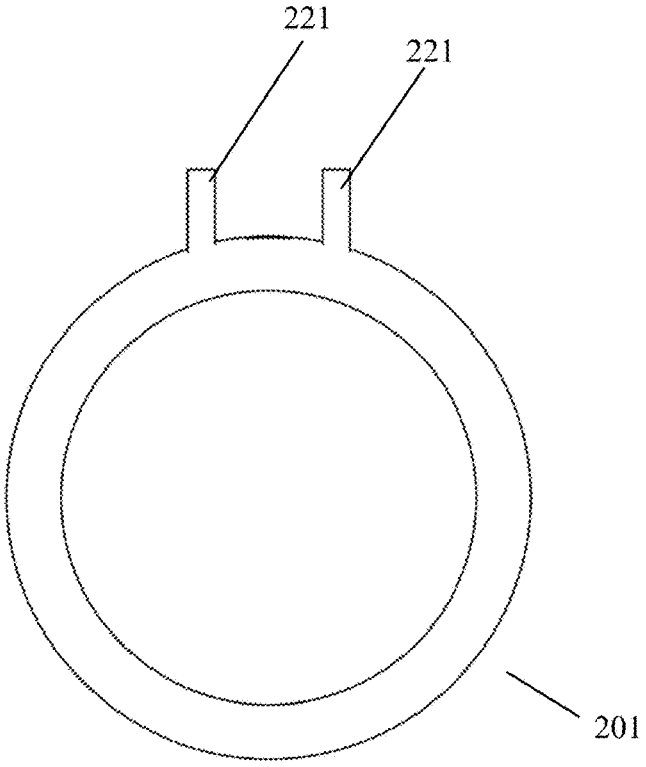
FIG. 8A is a top view showing the cover ring in the lid assembly of the present invention.
Figure 8B:
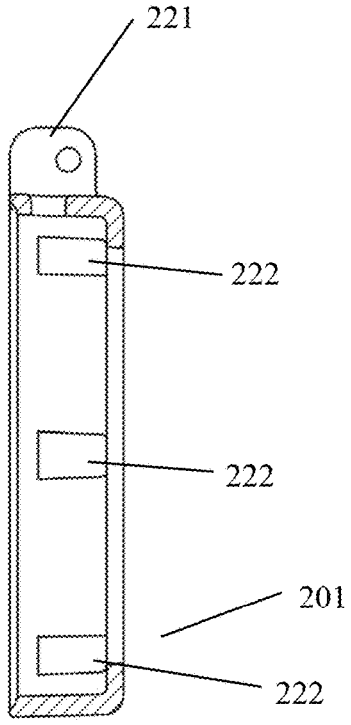
FIG. 8B is a cross-sectional view along A-A line in FIG. 8A.

In the lid assembly, the cover ring 201 supports the actuation mechanism 202 and holds the whole lid assembly together. The cover ring 201 fits between the actuation member 202 and the top of the receptacle 100 and supports and allows the lid assembly 200 to move between the open and a closed positions with regard to the receptacle. As shown in FIG. 8A, the cover ring 201 is secured by screws 212 (shown in FIG. 6A) to the actuation mechanism 202. As shown in FIGS. 8A and 8B, the cover ring 201 is pivotally attached to receptacle 100 through a pair of protrusions 221 that work with a pair of corresponding hinge pins 104 and bottom hinges 105 (shown in FIGS. 1A and 1B), thus allowing the lid assembly 200 being movable between an open and a closed positions relative to the receptacle 100.

Figure 6A:
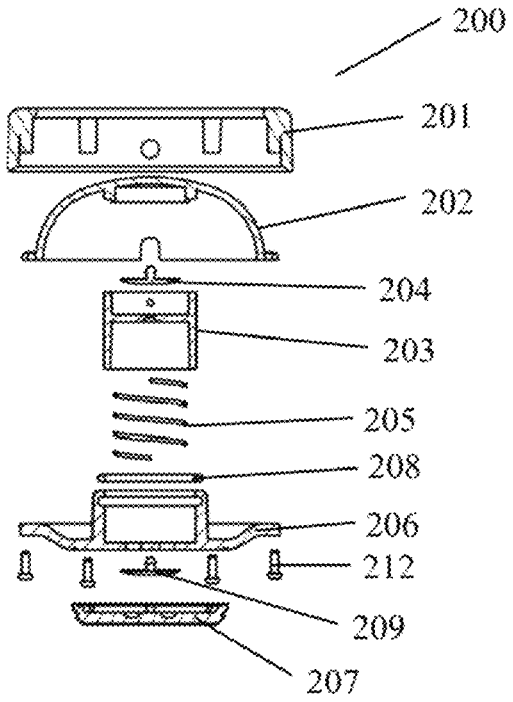
FIG. 6A is an enlarged exploded view of the lid assembly in the present invention.
Figure 6B:
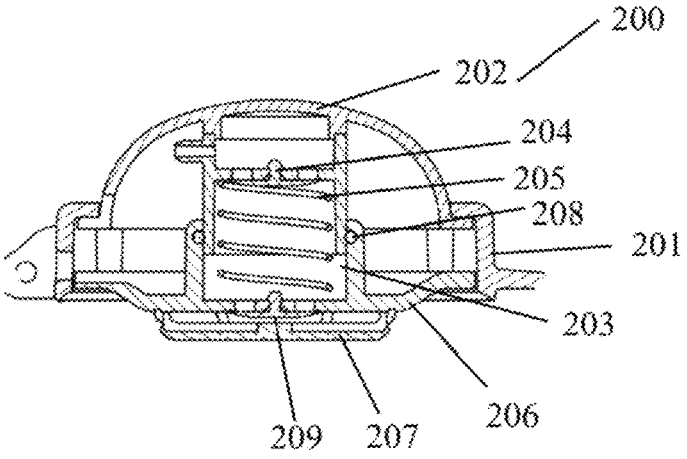
FIG. 6B is a cross-sectional view of the lid assembly in the present invention.

In the lid assembly, the embedded pump spray mechanism may be activated by the actuation mechanism and spray a cleaning solution stored in the liquid storage chamber each time a user activates it. The pump spray assembly is configured to distribute the cleaning solution from the liquid storage chamber to the receptacle in a form of a fine mist, and each spray dispenses approximately 4 ml cleaning solution to cover the receptacle 100. As shown in FIGS. 6A and 6B, the pump spray assembly mainly comprises a piston 203, a first body valve 204, a spring 205, a tube 210, a pump cylinder plate 206, an O-ring 208, a nozzle plate 207, and a second body valves 209.

The tube 210 connects the liquid storage chamber 117 with the pump spray assembly through a tightly fit access port 133 on the removable stop member 130 as shown in FIG. 5B. The tube 210 goes down to the bottom inside the liquid storage chamber 117. The tube 210 draws the cleaning solution from the liquid storage chamber 117 and feeds the cleaning solution into the pump spray assembly. In some embodiment of the present invention, the tube is approximately 6 inches long.

Figure 9B:
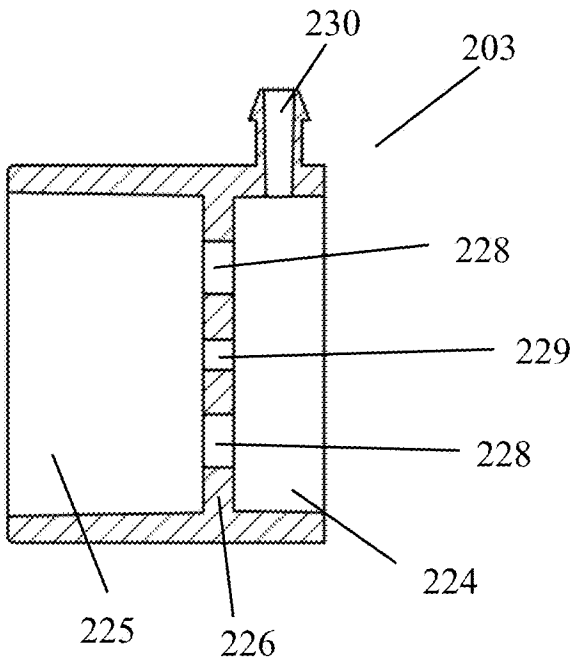
FIG. 9B is a cross-sectional view along A-A line in FIG. 9A.
Figure 9A:
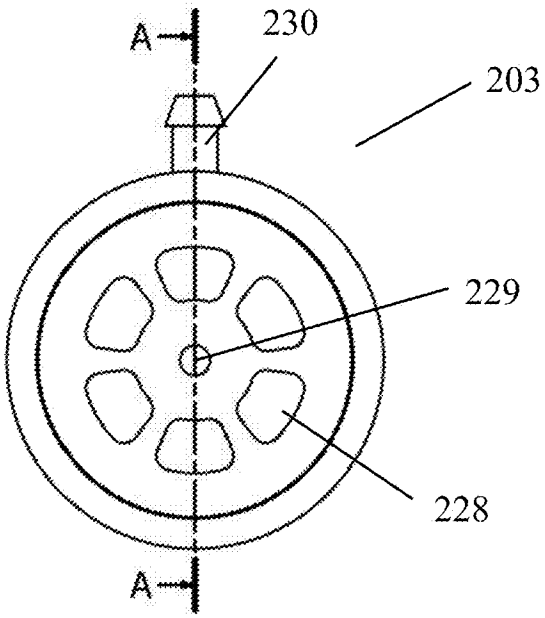
FIG. 9A is a top view of the piston in the lid assembly of the present invention.

As shown in FIGS. 9A and 9B, the piston 203 is configured to be activated by the actuation mechanism 202. The piston 203 is generally in a cylindrical shape and fits into the cylinder housing 227 on the pump cylinder plate 206. The O-ring fits between the piston and the cylinder housing 227 to ensure there is no leaking of liquid. The piston 203 comprises an upper chamber 224 and a lower chamber 225 in fluid communication and separated by a separation layer 226. The upper chamber 224 provides a snuggly fitted access port 230 for the tube 210, the separation plate 226 comprises a plurality of distribution holes 228 and is removably sealed by a first body valve 204 at the center 229.

In the pump spray assembly, the spring 205 is housed between the piston 203 and the pump cylinder plate 206 and configured to being compressed by the piston 203 and movable between a compressed state and a released state.

Figure 10B:
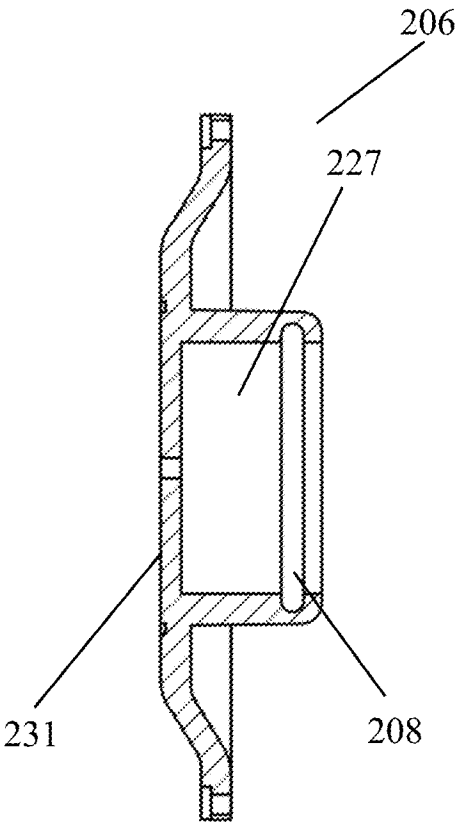
FIG. 10B is a cross-sectional view along A-A line in FIG. 10A.
Figure 10A:
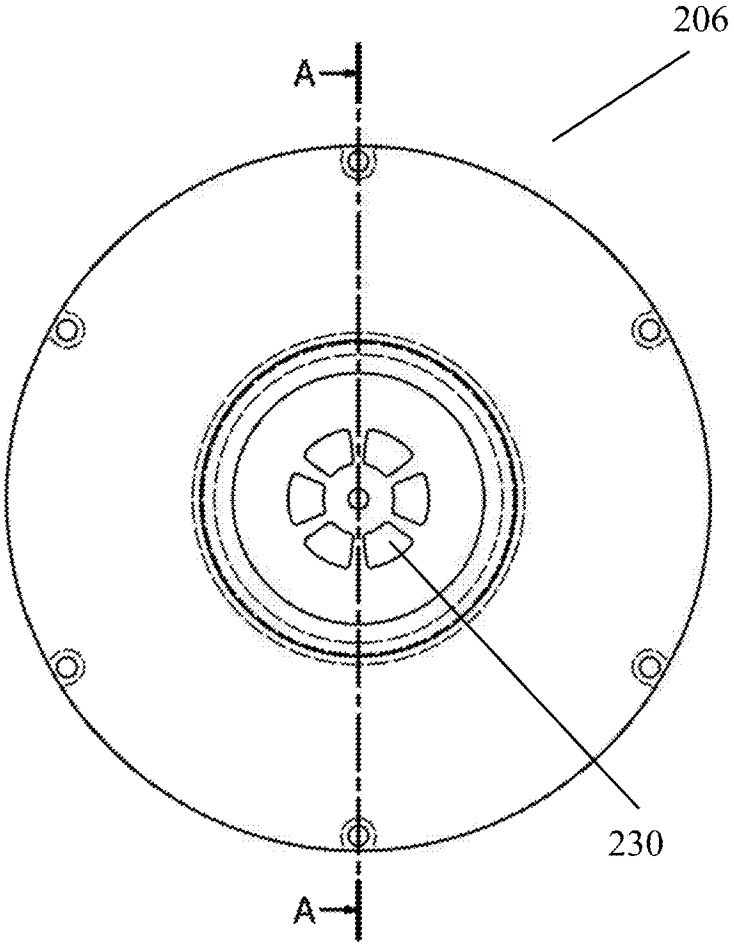
FIG. 10A is a top view of the pump cylinder plate in the lid assembly of the present invention.

As shown in FIGS. 10A and 10B, the pump cylinder plate 206 is configured to join with the cover ring 201 at bottom perimeter (such as by screws as shown in FIGS. 10A and 10B) to provide a housing for the lid assembly. The pump cylinder plate 206 comprises a cylinder housing 227 and a plurality of distribution holes 230, the cylinder housing 227 fits snuggly with the piston with the help of the O-ring 208, and along with the lower chamber 225 of the piston define a housing to hold the spring 205. The bottom 231 of the pump cylinder plate 206 is removably closed by the second body valve 209.

To ensure the watertight fit between the piston 203 and the pump cylinder plate 206 and hold the spring 205, an O-ring 208 is placed between the piston 203 and the pump cylinder plate 206 as shown in FIG. 6B.

Figure 11:
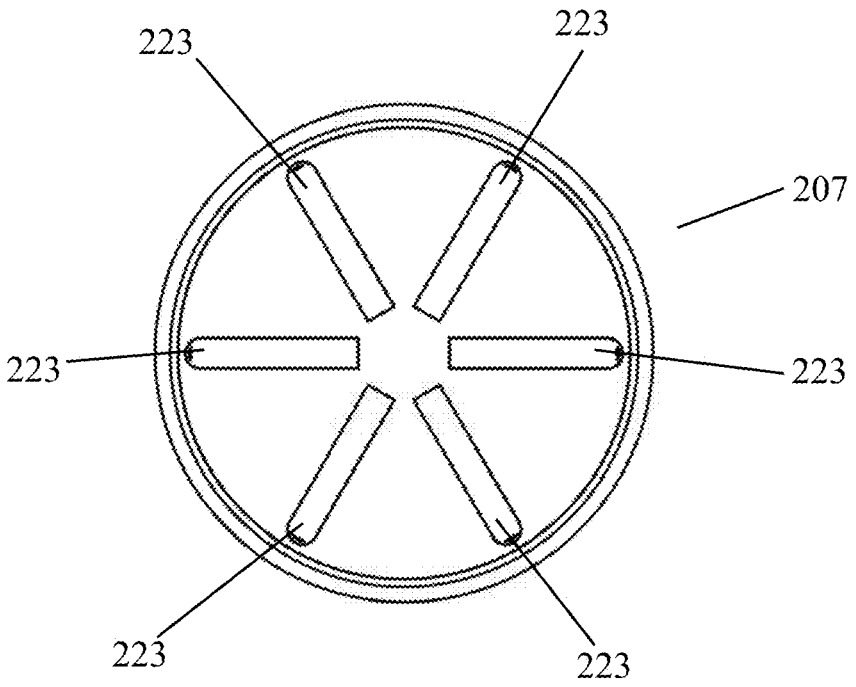
FIG. 11 is a top view showing the nozzle plate in the lid assembly of the present invention.

As shown in FIG. 11, a nozzle distribution plate 207 is attached to the bottom of the pump cylinder plate, wherein the nozzle distribution plate 207 comprises a plurality of distribution holes 223 and is configured to distribute the cleaning solution drawn from the liquid storage chamber to the receptacle in a form of fine mist. In the lid assembly, the pluralities of the distribution holes on the separation plate of the piston, the pump cylinder plate, and the nozzle distribution plate may be mismatched in place, different in sizes and configurations, or both, to create a fine mist to the receptacle.

The working mechanism of a pump spray assembly is known in the art. In the present invention, when the actuation mechanism is first used by the user and released, the vacuum created in the assembly draws the cleaning solution from the liquid storage chamber up to the upper chamber through the tube. When the user activates the actuation mechanism for use, the actuation mechanism acts on (pushes down) the piston 203 and through the force exerted by the spring 205, the cleaning solution is pressed down and through the piston chambers, the pump cylinder plate 206, and the nozzle distribution plate 207 to create a fine mist to the receptacle. Each spray is a mist of about 4 mL of cleaning solution, which covers the entire receptacle, and then drips down from the receptacle into the pipe and down the drain line, following the path of the urine. When the user releases the actuation mechanism, it creates a vacuum in the lid assembly, which causes the cleaning solution to be drawn from the liquid storage chamber to the lid assembly, ready for the next cycle of use.

The lid assembly 200 may be made of durable plastic material, such as polycarbonate. The pump spray assembly is built into the lid assembly 200 and operated to spray down into the receptacle 100 with a fine mist that covers the entire surface area of the receptacle 100.

Figure 12A:
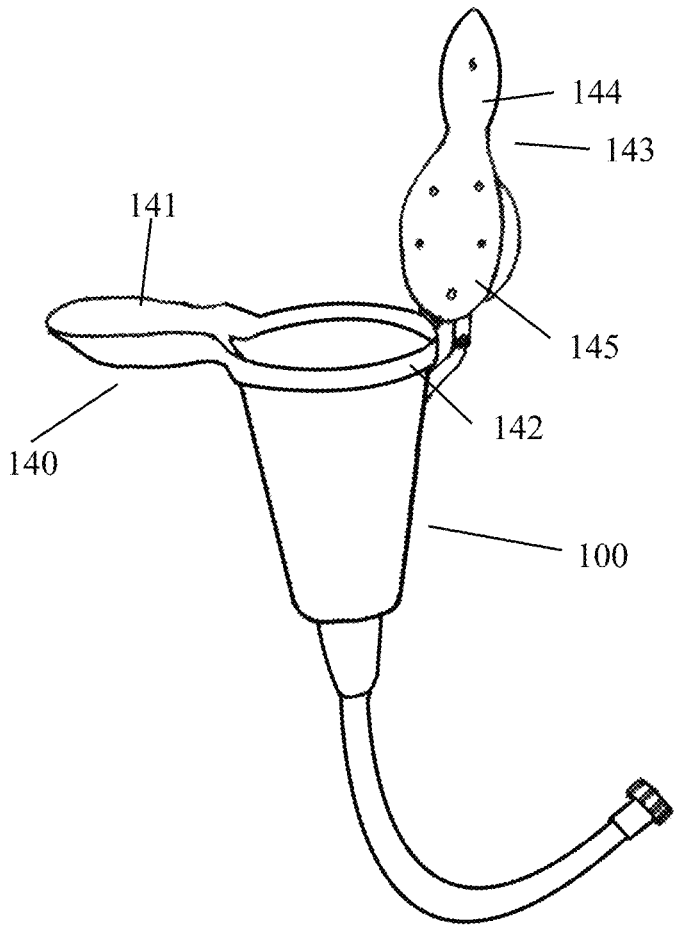
FIGS. 12A, 12B and 12C show structure of another embodiment of the waterless urinal of the present invention, which is adapted for use by female users, where
Figure 12B:
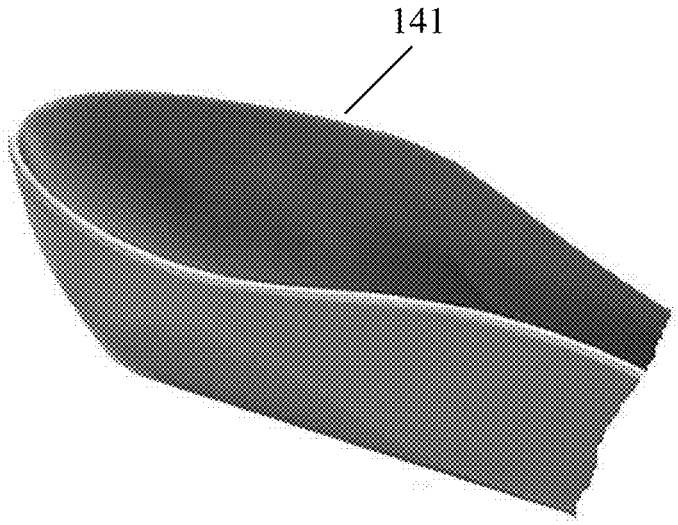

The waterless urinal of the present invention may be used by either male users or adapted for use by female users. As shown in FIG. 12A, the waterless urinal of the present invention may further comprise an accessory receptacle 140 adapted for use by a female user and the lid assembly 143 is adapted to cover the accessory receptacle 140. The accessory receptacle 140 comprises a cup portion 141 and an annular portion 142. The cup portion 141 is configured to receive urine from a female user, and the annular (ring) portion 142 is snugly fit onto the top of the receptacle 100. As shown in FIG. 12B, the cup portion 141 is adapted to the feminine anatomy to receive urine by a female user. The accessory receptacle may be made of any material that is sanitary to use and flexible enough to fit snugly on the receptacle, for examples, silicone rubber, polycarbonate, or other types of plastic or rubber.

Figure 12C:
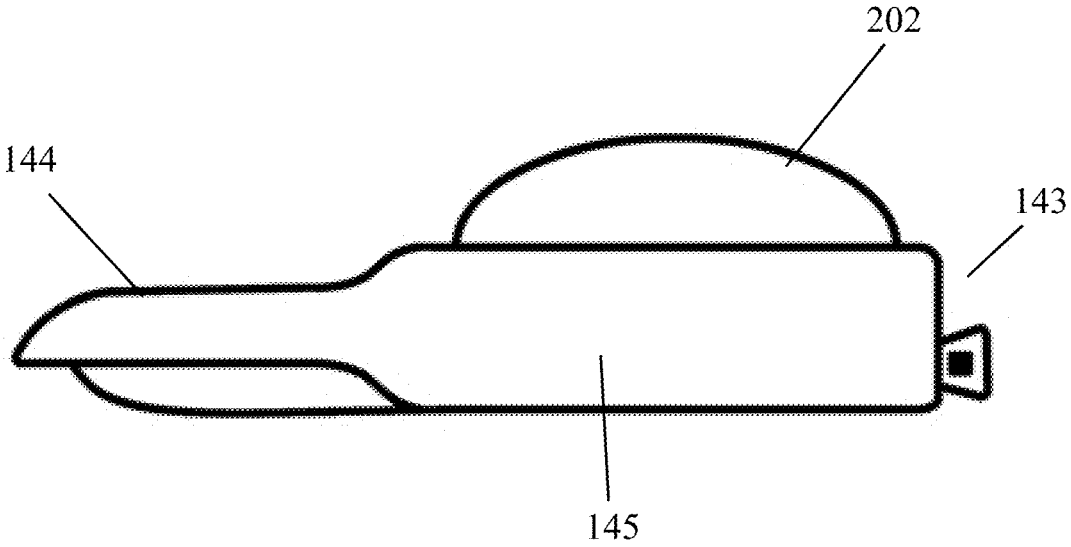

As shown in FIG. 12C, a lid assembly 143 is adapted to cover the accessory receptacle 140. The lid assembly 143 is removably attached to the receptacle and comprises a main portion 145 and an elongated portion 144 for covering the accessory receptacle 140 in a closed position. The lid assembly 143 has the same structure and function as the lid assembly 200 for male users, except that the plurality of the distribution holes on the bottom of the lid assembly are placed differently to cover the entire accessory receptacle 140 and receptacle 100.

Figure 14:
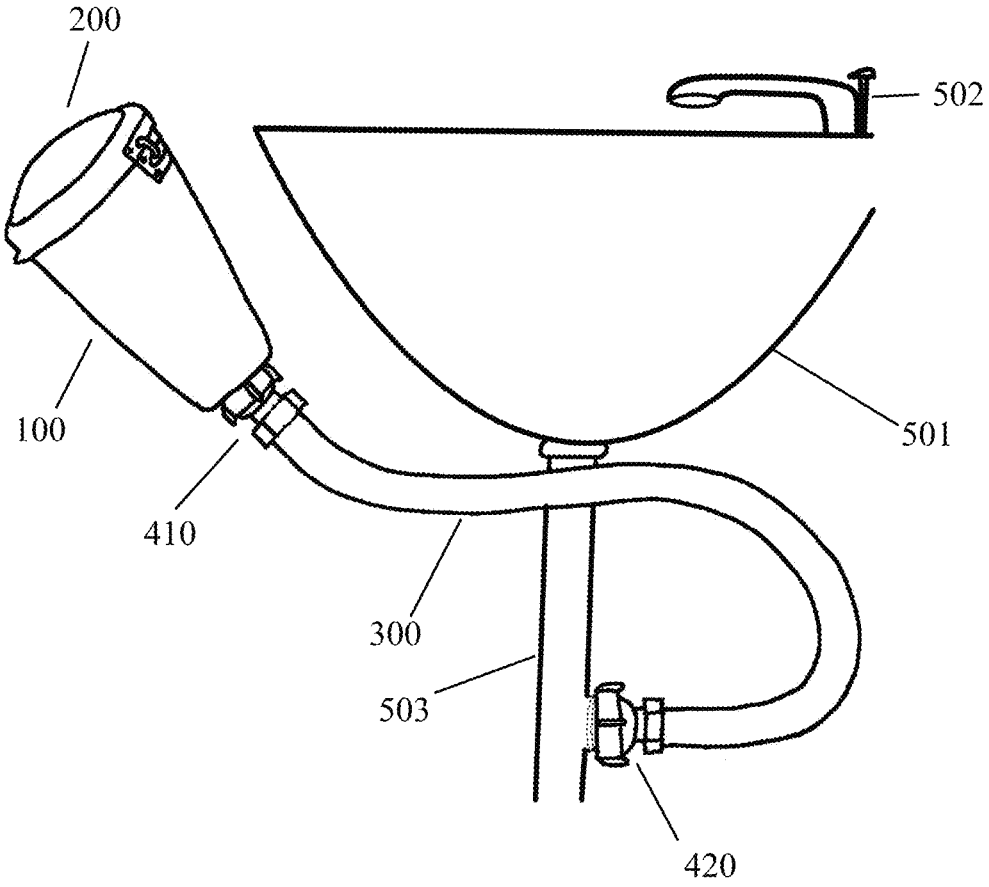
FIG. 14 shows the waterless urinal of the present invention as installed on a drain line of a sink with a pop-up drain.

As shown in FIGS. 1A and 14, the pipe 300 serves as the main fluid channel for discharging urine from the receptacle 100 to the waste line 503. The pipe 300 connects to the receptacle 100 and the waste line 503 through the first and second fitting members, respectively. In the present invention, the access port for the pipe on the waste line is at a position upstream of a water trap in the waste line. Therefore, the waterless urinal of the present invention may rely on the same water trap and does not need its own water trap. The pipe 300 is configured to allow urine to flow to the waste line due to gravity. One end 301 of the pipe 300 connects to the outlet of the receptacle and in fluid communication through a first fitting member 410 including a male fitting 411 and a female fitting 412, and the other end 302 of the pipe 300 connects to the drain line through a second fitting member 420 including a female fitting 421, a male fitting 422, and drain seal 423. Optionally, a cover cone 413 is provided to cover the bottom of the receptacle 100, the first fitting member, and the end of the pipe 300.

The pipe 300 is made of a material that is strong enough to support itself and the receptacle and lid assembly. Further, the pipe has certain malleability and is flexible enough to move to a comfortable position for use by the user. The pipe may be made of a metal, for examples, aluminum, or a flexible tube like Loc-Line that could be made of plastic, steel, aluminum or other materials. The pipe can also be made of PVC as long as it is flexible yet rigid enough to hold the urinal. The pipe may be coated with one or more protective layers on the outside and/or inside walls. The protective layers may be polyethylene or PVC. In one embodiment of the present invention, the pipe is made of an aluminum core coated with polyethylene on the outside and inside walls.

The pipe has a diameter in a range of between about 0.25 to about 1.5 inch, preferably, 0.3 to 0.7 inch, and more preferably, about 0.5 inch. The particular range of diameters can advantageously provide for an effective flow rate of the urine through the pipe. Typically, the length of the pipe is adapted to the space in the bathroom to allow it to be hidden under the sink or wash basin.

The first and second fitting members are made of durable metal material that is not corroded by water or urine and can be attached to the pipe by compression or other means. Suitable fitting members are known in the art of attaching the pipe to the drain line and the receptacle, such as rubber hose and clamp, thus they are not limited to those depicted in the drawings. The first and second fitting members may have small hand grips so that they can be attached by using the hand to spin tighten. The same male fitting and fitting nut may be used on both ends of the pipe for connection, and the conduit and lower portion of the inner body of the receptacle has the same size and thread configuration as the sink tailpipe for the drain line.

In the embodiment as shown in FIGS. 1A and 1B, the first fitting member comprises a cover cone 413, a male fitting 411, and fitting nut 412, where the cover cone 413 is configured to cover the part of the urinal where the lower portion of the inner body 101 connects to the first end 301 of pipe 300 through male fitting 411 and female fitting (fitting nut) 412; and the second fitting members comprises female fitting (fitting nut) 421, male fitting 422, and drain seal 423. The cover cone 413 may be made of thermoplastic polyurethane (TPU), thermoplastic elastomer (TPE), soft polyvinyl chloride (PVC), chrome, aluminum, steel, or other material. The female fittings (fitting nuts) 412, 421 have the same size and thread as the universal nut used in a pop-up drain access port on the sink tailpipe. The second fitting member comprises the drain seal 423 to provide a leakfree connection between the pipe and the drain line.

Figure 13:
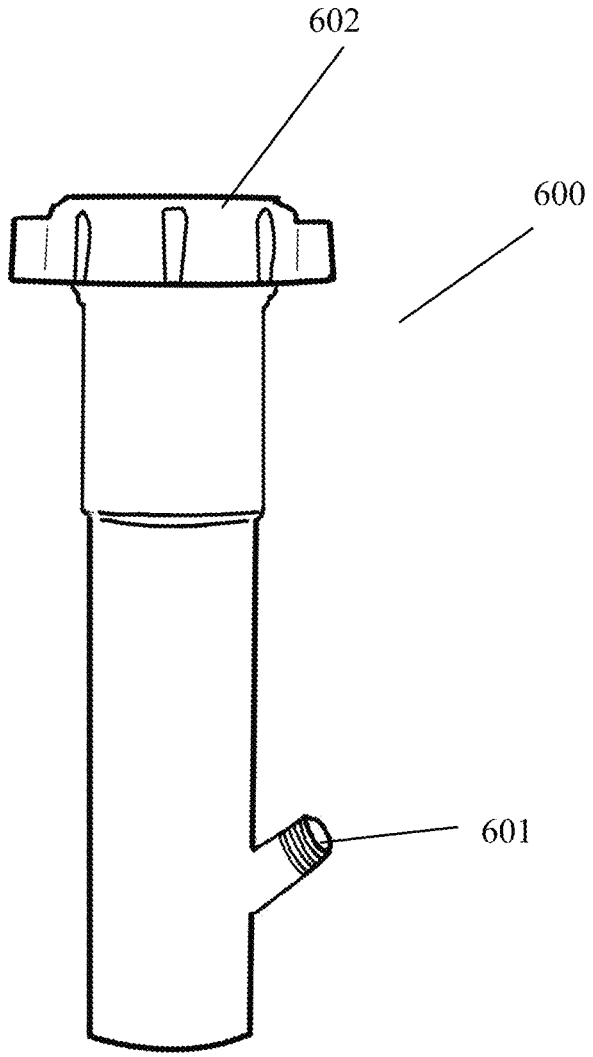
FIG. 13 is a side view showing the tailpiece to replace a drain line and provide an access port for the pipe of the waterless urinal in the present invention.

The present invention further provides a waterless urinal assembly comprising the waterless urinal as described above and a tailpiece configured to connect a drain line of a bathroom fixture to a waste line and provide an access port for connecting with the pipe through the second fitting member. As shown in FIGS. 13 and 14, the tailpiece 600 is configured to connect a drain line of a bathroom fixture to a P-trap in a waste line and provide an access port 601 for the pipe 300 through the second fitting member. The tailpiece 600 comprises a nut 602 and gasket 603 (not shown) for connection to the drain line of the bathroom fixture and provide the access port 601 for connection with the pipe 300. The tailpiece 600 may be made of PVC, chrome, or stainless steel. The tailpiece is particularly useful for sinks or bathroom fixtures that do not have a pop-up drain and can be used to replace the existing drain line to provide an access port for the waterless urinal, or for new builds and replacements of the bathroom fixtures. The tailpiece that connects the sink drain to the P-trap is adapted with an access port of the same specification as the pop-up drain port for connection with the pipe via the second fitting member. Plumbing pieces may be adopted for both universal fits or Moen pop-up drain fit.

The present invention further provides a method for installing the waterless urinal in connection with the bathroom fixture, which comprises the steps of providing the waterless urinal of the present invention, providing an access port on a drain line of a bathroom fixture, connecting the pipe to the access port through the second fitting member, wherein the access port is upstream of a water trap. The water trap may be any form conventionally used in the bathroom plumbing, such as a P-trap or a U-trap. By installing the pipe upstream of the water trap in the waste line for the bathroom fixture, it is ensured that the odor or gas from the waste line will not enter the residences through the waterless urinal. Additionally, when the bathroom fixture is used, water will go down to further flush any urine remained at the water trap, thus, helping maintaining the waste line and preventing buildup by urine.

As shown in FIG. 14, the bottom of the receptacle 100 of the waterless urinal is connected to and in fluid communication with one end 301 of the pipe 300 through a first fitting member 410, which includes a male fitting 411 and a female fitting (fitting nut) 412. The other end 302 of the pipe 300 is attached to a drain line 503 of a sink or wash basin 501 through a second fitting member 420, which includes a male fitting 422, a female fitting (fitting nut) 421, and a drain seal 423. In the embodiment, sink or wash basin 501 has a pop-up drain (not shown in the figure) with lever 502. The pipe 300 is self-supporting and supports the receptacle 100 and the lid assembly 200.

In the present invention, the waterless urinal may be installed or retrofitted to a bathroom fixture. In one embodiment of the present invention, the bathroom fixture may be a sink or wash basin with a pop-up drain, and the method further comprises the steps of removing the pop-up drain to expose the access port on the drain line used by the removed pop-up drain of the sink or wash basin and installing and connecting the pipe to the access port via the second fitting member.

In another embodiment of the present invention, the bathroom fixture does not have a pop-up drain, and the method further comprises the steps of providing a tailpiece configured to connect the drain line of a bathroom fixture to a P-trap and provide the access port for the pipe, substituting the drain line of the bathroom fixture with the tailpiece, thereby, providing the access port for the pipe, and installing and connecting the pipe to the access port via the second fitting member.

EXAMPLE

Example 1. In-Home Waterless Urinal for Male User

A waterless urinal as shown in FIG. 1B is installed to a sink with a pop-up drain. The receptacle is made of stainless steel; and the pipe is made of aluminum core covered with PE on the outside and the inside and has a diameter of 0.5 inch. The liquid storage chamber holds 20 oz 6% vinegar. Each spray is about 4 ml. In an average American household with two males, the waterless urinal of the present invention can save over 670 gallons of water per month. (1.6 gallons per flush with water efficient toilet×average 7 uses per day×2 people×30 days).

The waterless urinal of the present invention is in the particular size and configuration to minimize splashing caused by urination. It greatly shortens the distance so the stream of urine doesn't break into beads but remains a stream that can go down the pipe smoothly. The shorter distance reduces the impact, lessens the opportunity for splashing. The inside of the receptable in a cone or cone-like shape creates an angled impact to reduce the chance of direct hit stream which also lowers incidence of splashing. Finally, in the rare incidence of any splashing, the placement of the receptacle in close proximity to the user and the shape of the receptacle result in any splashback remaining within the urinal. The waterless urinal of the present invention also virtually eliminates the dripping because the user can adjust to maximize comfort and minimize possibility of dripping. The other factor that causes a messy toilet area that is eliminated by the present invention is flushing. When a toilet is flushed, some of the particles inside the bowl become aerosolized and distributed to the surfaces around it.

The waterless urinal of the present invention can easily retrofit into existing bathrooms and be adapted for use by both male and female users. The waterless urinal of the present invention avoids calcification buildup which causes clogging drains and bad odor on the inside. It is easy to install and requires minimum plumbing, special plumbing tools, and specialized installation skills to install or retrofit. The waterless urinal of the present invention may fit any sink or wash basin with a pop-up drain or be adapted for use in any sink or wash basin without a pop-up drain. The waterless urinal of the present invention provides a simple, cost-saving, and effective solution for use in private spaces.

The waterless urinal of the present invention is made of sturdy, solid, high-quality, and long-lasting material. It provides a sleek and attractive look and feel of a high-end bathroom appliance and is designed to minimize costs of production and shipping. Recycled or recyclable parts may be used, and environmentally harmful chemicals are not required.

I claim:

1. A waterless urinal, comprising (1) a receptacle adapted for receiving and discharging urine from a user, wherein the receptacle comprises an inner body in a form of a funnel, wherein the inner body comprises an upper portion and a lower portion, the upper portion defines a cavity for receiving urine, the lower portion comprises a conduit for discharging the urine, and the lower portion is connected to a bottom of the upper portion at a first end and being an outlet for discharging the urine at a second end, an outer body in a form of a truncated cone, wherein the outer body are joined with the inner body at the top and substantially covers the inner body, a bottom of the outer body comprises a passage to allow the lower portion of the inner body to tightly fit and pass through such that the tops and side walls of the inner body and the outer body and the bottom of the outer body together define a leakproof space, a liquid storage chamber provided by the leakproof space, wherein the liquid storage chamber comprises an access port on a top portion of the outer body of the receptacle, and a removable stop member configured to seal the access port and maintain watertightness of the liquid storage chamber, (2) a lid assembly configured for removably covering the receptacle and movable between an open and a closed positions, where in the lid assembly comprises:

an actuation mechanism adapted for being actuated by a user, a cover ring fitted between the actuation member and the top of the receptacle and supports the lid assembly to move between the open and the closed positions, a pump spray assembly in fluid communication with the liquid storage chamber, wherein the pump spray assembly is configured to be activated by the actuation member, and in response, to distribute a cleaning solution from the liquid storage chamber to the receptacle in a form of a mist, (3) a pipe in fluid communication with the receptacle for discharging the urine to a waste line, wherein the pipe is connected to the receptacle through a first fitting member and to the waste line through a second fitting member, and the pipe bendably and flexibly supports the receptacle and the lid assembly to move to different positions and heights.

2. The waterless urinal according to claim 1, wherein the pipe is connected to the waste line at a position upstream of a water trap in the waste line.

3. The waterless urinal according to claim 1, wherein the inner body comprises a fold over rim along a circumference at the top of the inner body, and the top of the outer body are joined with the fold over rim.

4. The waterless urinal according to claim 1, wherein a downward inclination angle $\alpha$ of the side wall of the outer body is smaller than a downward inclination angle $\beta$ of the side wall of the upper portion of the inner body.

5. The waterless urinal according to claim 1, wherein the cover ring is pivotally attached to the receptacle through hinge structure.

6. The waterless urinal according to claim 1, further comprising an accessory receptacle adapted for use by a female user, wherein the accessory receptacle comprises a cup portion and a ring portion, the cup portion is configured to receive urine from the female user, and a ring portion is connected to the cup portion and snuggly fitted to the top of the receptacle, wherein the lid assembly is configured to cover the cup portion and the ring portion of the accessory receptacle.

7. The waterless urinal according to claim 1, wherein the pump spray assembly further comprises:

a tube connecting the liquid storage chamber with the pump spray assembly through a tightly fit access port on the removable stop member, a piston configured to be activated by the actuation means, wherein the piston comprises an upper chamber and a lower chamber in fluid communication and separated by a separation layer, the upper chamber provides a snuggly fitted access port for the tube, the separation layer comprises a plurality of distribution holes and is removably sealed by a first body valve, a spring configured to being compressed by the piston and movable between a compressed state and a released state, a pump cylinder plate configured to join with the cover ring at perimeter, wherein the pump cylinder plate comprises a cylinder housing portion and a plurality of distribution holes, the cylinder housing portion and the piston define a housing to snuggly fit the spring, and a bottom of the pump cylinder plate is removably sealed by a second body valve, an O-ring between the piston and the pump cylinder plate to ensure a snug fit, and a nozzle distribution plate attached to the bottom of the pump cylinder plate, wherein the nozzle distribution plate comprises a plurality of distribution holes and is configured to distribute the cleaning solution drawn from the liquid storage chamber to the receptacle.

8. The waterless urinal according to claim 7, wherein the pluralities of the distribution holes on the separation layer of the piston, the pump cylinder plate, and the nozzle distribution plate are mismatched in place, different in sizes and configurations, or both, to create a fine mist to the receptacle.

9. The waterless urinal according to claim 1, wherein the cleaning solution is a cleaning vinegar.

10. The waterless urinal according to claim 1, wherein the pipe is coated with an anticorrosive layer on an inside wall, an outside wall, or both.

11. A waterless urinal assembly, comprising the waterless urinal as described in claim 1, and a tailpiece configured to connect a drain line of a bathroom fixture to a waste line and provide an access port for connecting with the pipe through the second fitting member.

12. A method for installing a waterless urinal in connection with a bathroom fixture, comprising providing the waterless urinal as described in claim 1, providing an access port on a drain line of a bathroom fixture, connecting the pipe to the access port through the second fitting member, wherein the access port is upstream of a water trap.

13. The method of claim 12, wherein the bathroom fixture is a sink or wash basin with a pop-up drain, and the method further comprising:

removing the pop-up drain to expose the access port on the drain line used by the removed pop-up drain, and installing and connecting the pipe to the access port.

14. The method of claim 12, wherein the water trap is a P-trap.

15. The method of claim 12, wherein the bathroom fixture does not have a pop-up drain, and the method further comprising providing a tailpiece configured to connect the drain line of a bathroom fixture to a waste line and provide the access port for the pipe, substituting the drain line of the bathroom fixture with the tailpiece, and installing and connecting the pipe to the access port.

* * * * *